US008425077B2

(12) United States Patent
Wu

(10) Patent No.: US 8,425,077 B2
(45) Date of Patent: Apr. 23, 2013

(54) ILLUMINATING COSMETIC APPLICATOR

(75) Inventor: Chien-Lin Wu, Tainan (TW)

(73) Assignee: Li Shin Tai Co., Ltd., Tainan (TW)

( * ) Notice: Subject to any disclaimer, the term of this patent is extended or adjusted under 35 U.S.C. 154(b) by 90 days.

(21) Appl. No.: 13/102,280

(22) Filed: May 6, 2011

(65) Prior Publication Data

US 2012/0281396 A1 Nov. 8, 2012

(51) Int. Cl.
*F21L 4/00* (2006.01)
*F21L 4/02* (2006.01)

(52) U.S. Cl.
USPC ..... 362/190; 362/205

(58) Field of Classification Search ..... 362/190, 362/202–206; 401/195
See application file for complete search history.

(56) References Cited

U.S. PATENT DOCUMENTS 2,651,709 A * 9/1953 Ross et al. ..... 362/577
2007/0286665 A1 * 12/2007 Bouix et al. ..... 401/1

FOREIGN PATENT DOCUMENTS

TW M373679 U1 2/2010

* cited by examiner

*Primary Examiner* — Karabi Guharay
*Assistant Examiner* — Nathaniel Lee
(74) *Attorney, Agent, or Firm* — Rosenberg, Klein & Lee

(57) ABSTRACT

An illuminating cosmetic applicator is revealed. The illuminating cosmetic applicator includes a cosmetic applicator part, a connector, and a lighting unit. The cosmetic applicator part is made from a transparent material. One end of the connector is connected to the cosmetic applicator part while the other end thereof is mounted with the lighting unit. The lighting unit consists of a light gathering cover mounted in a housing, and a light emitting element in the light gathering cover. Batteries are received in the housing. Moreover, a groove mounted with a switch is arranged at the housing. A block is connected to the inner side of the switch. Thereby light is emitted through the cosmetic applicator part while applying cosmetics in a dark place. Furthermore, the lighting unit can be separated with the cosmetic applicator part and used for illumination independently. The illuminating cosmetic applicator has more practical value.

3 Claims, 5 Drawing Sheets

ILLUMINATING COSMETIC APPLICATOR

BACKGROUND OF THE INVENTION

1. Field of the Invention

The present invention relates to an illuminating cosmetic applicator, especially to an illuminating cosmetic applicator that not only emits light through a cosmetic applicator part while applying cosmetics in a dark place but also provides light by a lighting unit separated with the cosmetic applicator part. The lighting unit is used to emit light directly. The illuminating cosmetic applicator has more practical value.

2. Description of Related Art

It is a human nature that people want to look good, especially women, always try to improve their appearance. Thus they put makeup on their faces not just for beauty but also for politeness. The essential cosmetics such as eye shadows, mascaras, lipsticks are used to make eye and lips more attractive.

As to containers for cosmetics, the cosmetic manufacturers design the containers with curved edges, colorful paintings, carved reliefs, decorative crystals or made from phosphors for winning the attention of consumers. Thus consumers may be attracted to containers with different styles and then buy a series of products for collections.

Among these cosmetic products, some cosmetic containers provide the illumination function to attract people's attention. Refer to Taiwanese Pat. Pub. No. M373679 "cosmetic container with illumination apparatus" published on Feb. 11, 2000, a cosmetic container with illumination apparatus includes a hollow bottle body with a bottle mouth, a bottle cap, a light guide body and an illumination apparatus. The bottle cap is arranged at the bottle mouth of the bottle body. A cell is disposed on a front end of the bottle cap for loading lipstick and the light guide body is arranged around the cell. As to the illumination apparatus, it is hidden between the hollow bottle body and a top of the bottle cap.

Although the above cosmetic container with illumination apparatus really allows the cosmetic container emits light, the design is used together with cosmetics (such as lipstick, lip gloss, etc.). The illumination apparatus is unable to be separated and used independently. This causes great inconvenience in some cases and there is room for improvement.

SUMMARY OF THE INVENTION

Therefore it is a primary object of the present invention to provide an illuminating cosmetic applicator that not only emits light from a cosmetic applicator part for illumination while applying cosmetics in a dark place but also includes a removable lighting unit. The lighting unit can be removed from the illuminating cosmetic applicator, separated with the cosmetic applicator part, and used independently. Thus the illuminating cosmetic applicator of the present invention has more practical value.

In order to achieve the above object, an illuminating cosmetic applicator of the resent invention includes a cosmetic applicator part, a connector, and a lighting unit. The cosmetic applicator part is made from a transparent material. One end of the connector is a connection part connected and fixed to the cosmetic applicator part while the other end thereof is a sleeve part mounted with the lighting unit. The lighting unit is composed of a light gathering cover arranged in a housing, and a light emitting element disposed in the light gathering cover. The housing is also used to load batteries. Moreover, a groove is arranged at the housing and is assembled with a switch. A block is connected to the inner side of the switch.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
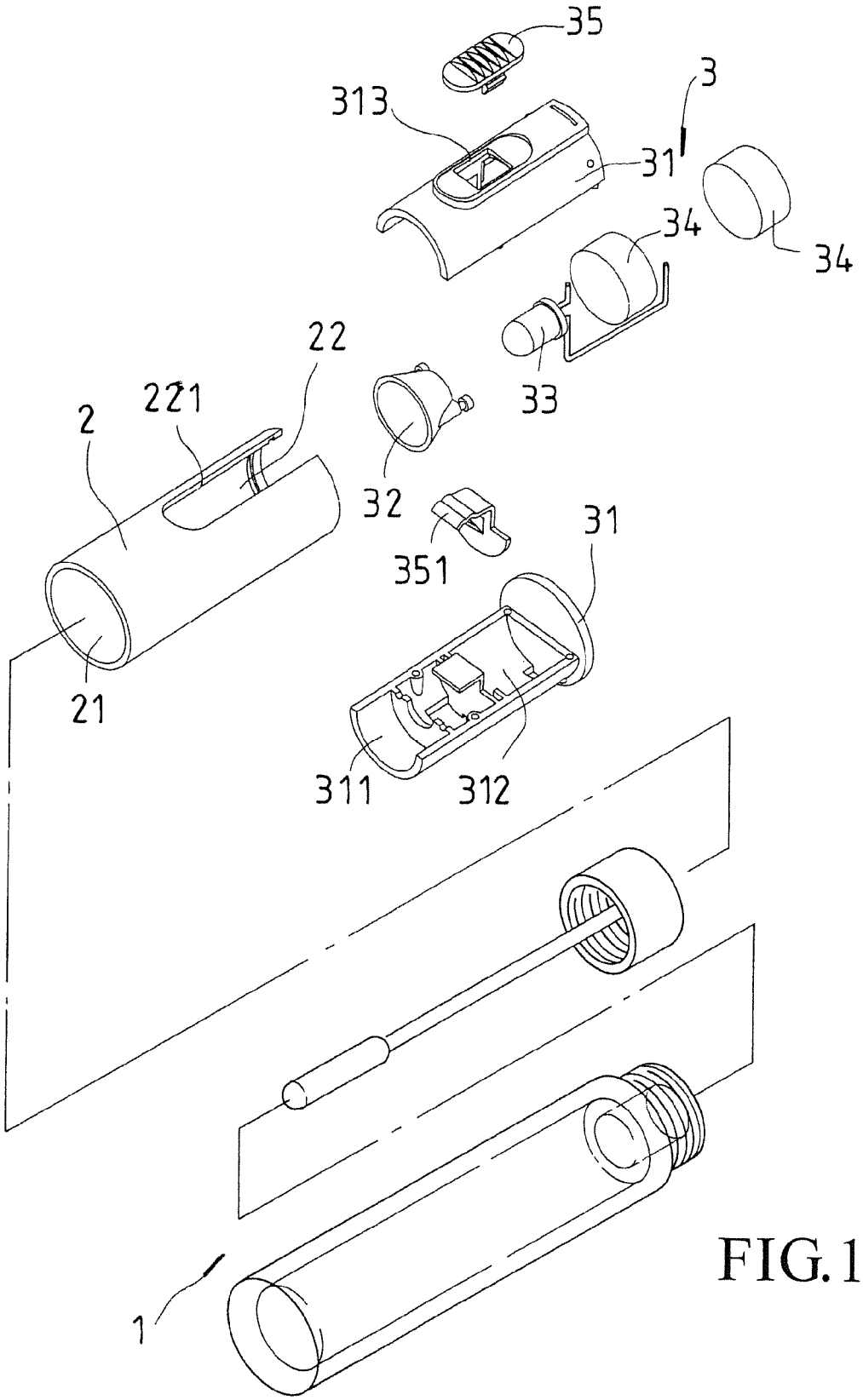
FIG. 1 is an explosive view of an embodiment according to the present invention.

Refer to FIG. 1, an illuminating cosmetic applicator includes a cosmetic applicator part 1, a connector 2, and a lighting unit 3.

The cosmetic applicator part 1 can be a cosmetic container or a make-up tool, made from a transparent material.

The connector 2 includes a connection part 21 on one end and a sleeve part 22 on the other end. The connection part 21 is used to connect the connector 2 with the cosmetic applicator part 1. The sleeve part 22 is sleeved with and connected to the lighting unit 3. A slot 221 is mounted on the sleeve part 22 of the connector 2.

The lighting unit 3 includes a housing 31 corresponding to the sleeve part 22 of the connector 2, a light gathering cover 32, a light emitting element 33, at least one battery 34 and a switch 35. A space inside the housing 31 includes a first receiving space 311 and a second receiving space 312. The first receiving space 311 is used to mount the light gathering cover 32 while the second receiving space 312 is used to load the battery 34. The light emitting element 33 is arranged in the light gathering cover 32. Moreover, a groove 313 corresponding to the slot 221 of the connector 2 is arranged at the housing 31 and the switch 35 is disposed in the groove 313. A block 351 is connected to the inner side of the switch 35. The block 351 is used to push against a pin of the light emitting element 33 for control of contact between the pin of the light emitting element 33 and the battery 34.

Figure 2:
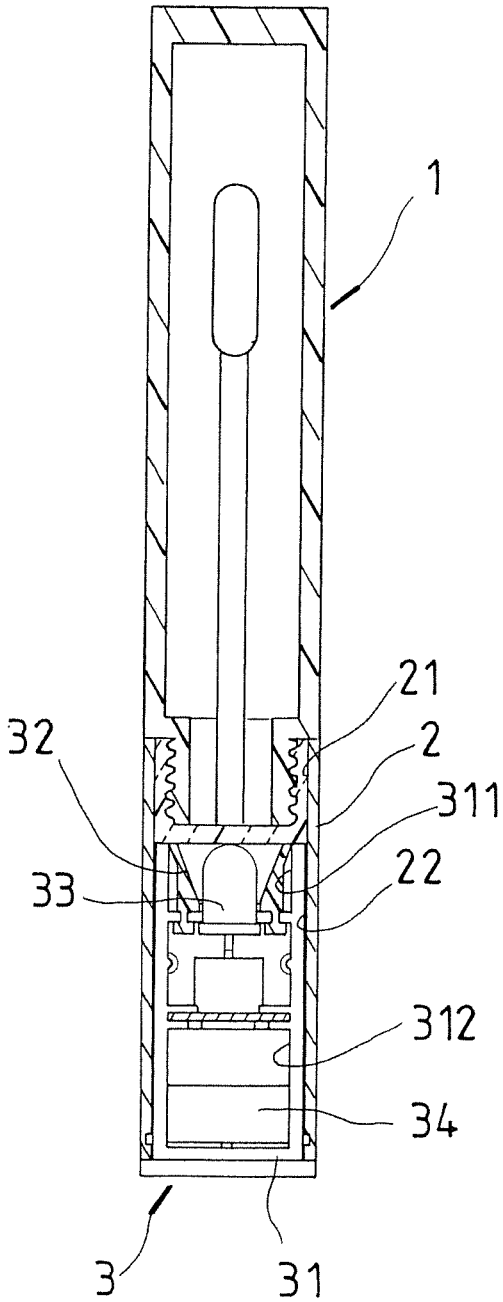
FIG. 2 is a cross sectional view of an assembled embodiment according to the present invention.
Figure 3:
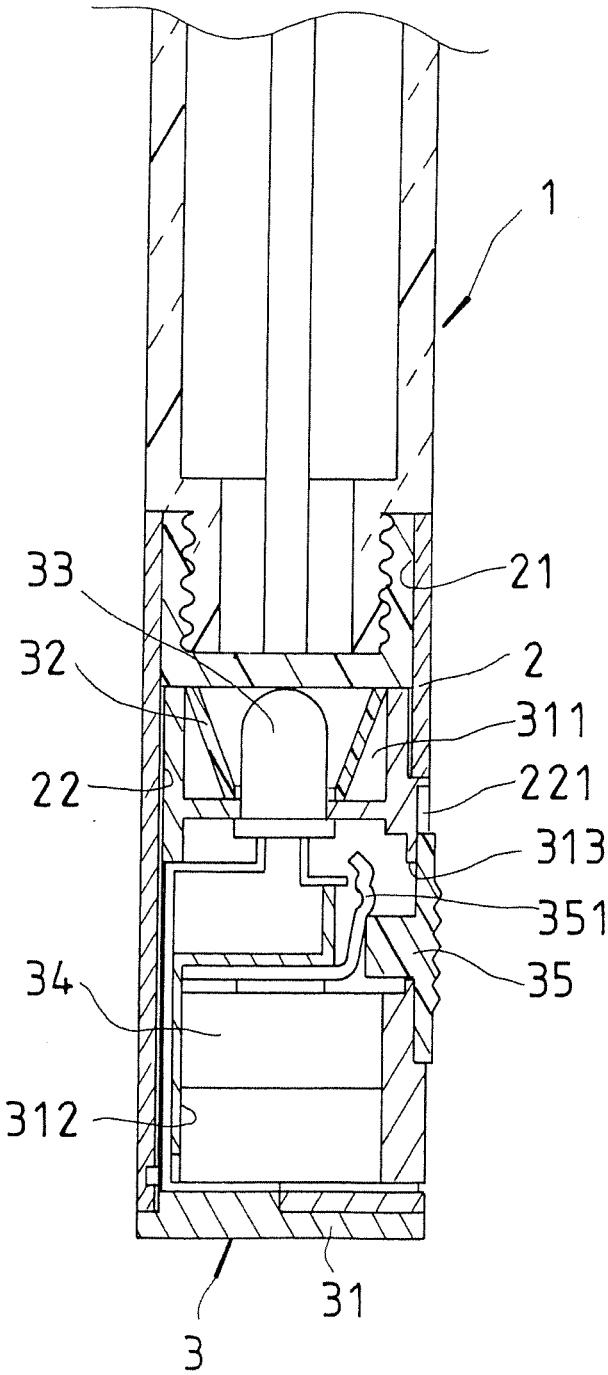
FIG. 3 is a partial enlarged cross sectional view of an assembled embodiment according to the present invention.

While being assembled, refer to FIG. 2 and FIG. 3, the cosmetic applicator part 1 is connected and secured to the connection part 21 of the connector 2. The housing 31 of the lighting unit 3 is mounted into the sleeve part 22 of the connector 2. Then the switch 35 disposed on the groove 313 and exposed on the housing 31 is just located in the slot 221 of the connector 2.

Figure 4:
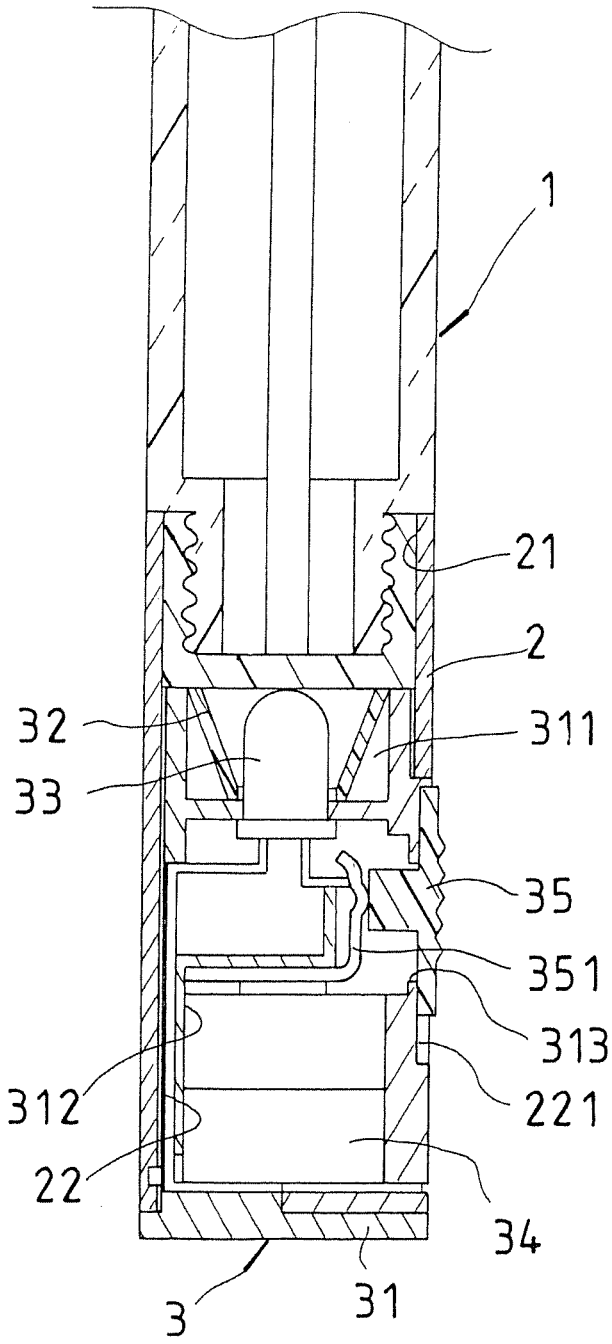
FIG. 4 is a partial enlarged cross sectional view of an embodiment in use according to the present invention.

In use, refer to FIG. 4, when the switch 35 of the lighting unit 3 is pushed, the block 351 connected to the inner side of the switch 35 is against the pin of the light emitting element 33 so as to make the pin of the light emitting element 33 in contact with the battery 34. Thus power is delivered to the light emitting element 33 and the light emitting element 33 generates light. The light generated passes through the cosmetic applicator part 1 made from a transparent material to be emitted outside. Thus users can apply cosmetics with cosmetic applicators on a dark place.

Figure 5:
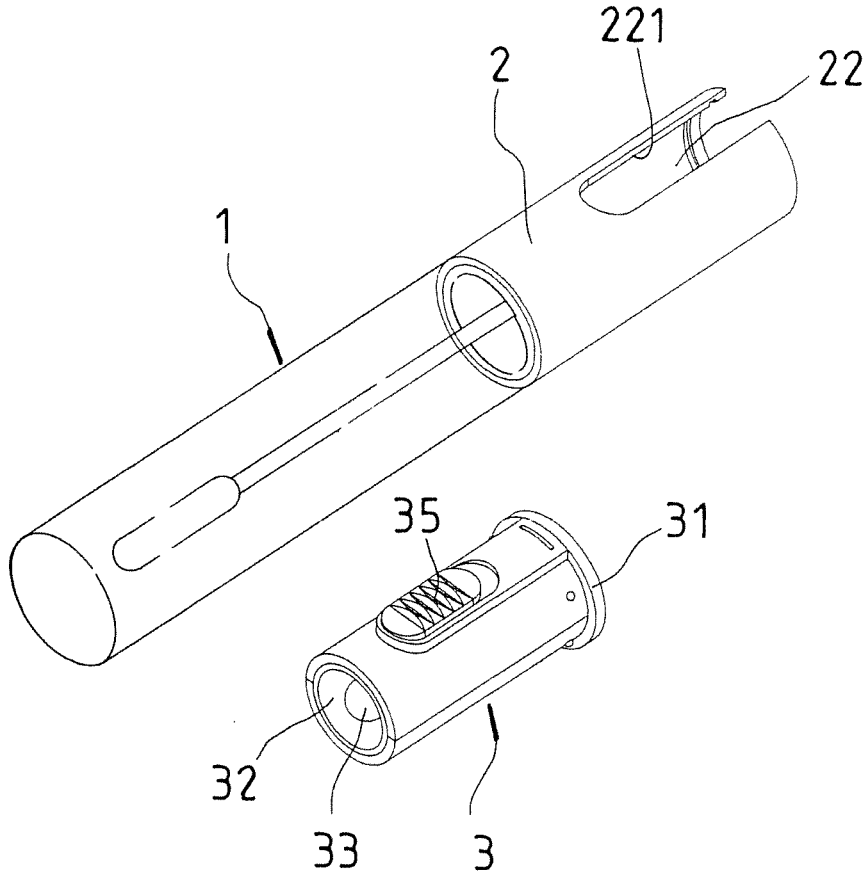
FIG. 5 is a perspective view of an embodiment in use according to the present invention.

Moreover, refer to FIG. 5, the housing 31 of the lighting unit 3 mounted in the sleeve part 22 of the connector 2 can also be pulled out so that the lighting unit 3 can be used independently as a lighting tool.

In summary, compared with the structure available now, the illuminating cosmetic applicator of the present invention emits light and allows users to apply cosmetics on a dark place. Moreover, the lighting unit of the present invention can be used independently. When the user needs more light, the lighting unit is pulled out and is separated with the cosmetic applicator part. Then the lighting unit is used as a flashlight. For example, it can provide sufficient light while opening vehicles doors, or door locks or looking for lost things at night. There is no need to take out the whole device because the cosmetic applicator part may be messed up. The illuminating cosmetic applicator has more practical value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An illuminating cosmetic applicator comprising:

a cosmetic applicator part made from a transparent material;

a connector having a connection part formed on one end thereof being connected and fixed to the cosmetic applicator part, the connector having a sleeve part formed on an opposing end thereof; and a lighting unit removably inserted into the sleeve part of the connector, the lighting unit including a housing dimensioned to be received within the sleeve part of the connector, a light gathering cover disposed within the housing, a light emitting element positioned within the light gathering cover, a switch mounted in a groove formed in an external wall of the housing and electrically connected to the light emitting element, and at least one battery disposed within the housing and electrically connected between the light emitting element and the switch, the switch including a block connected to an inner side of the switch and used to control contact between at least one pin of the light emitting element and the battery, the lighting unit being removable from the sleeve part of the connector to be operable as a lighting device independent of the cosmetic applicator part.

2. The device as claimed in claim 1, the sleeve part of the connector has a slot formed therein disposed in correspondence with the groove of the housing.

3. The device as claimed in claim 1, wherein the housing of the lighting unit includes a first receiving space and a second receiving space therein; the first receiving space having the light gathering cover mounted therein, and the second receiving space having the at least one battery located therein.

* * * * *